US008028730B2

(12) United States Patent
Whiting et al.

(10) Patent No.: US 8,028,730 B2
(45) Date of Patent: Oct. 4, 2011

(54) PURSE WITH INTERCHANGEABLE DECORATIVE LINERS

(75) Inventors: Carolyn Whiting, Elgin, SC (US); Rebecca S. McKenzie, Blythewood, SC (US)

(73) Assignee: Carolyn Whiting, Columbia, SC (US)

( * ) Notice: Subject to any disclaimer, the term of this patent is extended or adjusted under 35 U.S.C. 154(b) by 815 days.

(21) Appl. No.: 11/718,501

(22) PCT Filed: Oct. 31, 2005

(86) PCT No.: PCT/US2005/039126

§ 371 (c)(1), (2), (4) Date: Dec. 5, 2007

(87) PCT Pub. No.: WO2006/050189

PCT Pub. Date: May 11, 2006

(65) Prior Publication Data

US 2008/0230157 A1 Sep. 25, 2008

Related U.S. Application Data

(60) Provisional application No. 60/623,863, filed on Nov. 2, 2004, provisional application No. 60/649,086, filed on Feb. 3, 2005.

(51) Int. Cl.

| | |
|---|---|
| ***A45C 3/08*** | (2006.01) |
| ***A45C 13/08*** | (2006.01) |
| ***A45C 1/02*** | (2006.01) |
| ***A45C 13/10*** | (2006.01) |

(52) U.S. Cl. ..... 150/104; 150/107; 150/119; 150/130; 190/127; 383/105; 383/106; 383/111

(58) Field of Classification Search ..... 150/103–105, 150/119, 130, 111, 120; 190/18 R, 40, 127; 383/105, 106, 111; 40/720, 722; 206/455; 220/655

See application file for complete search history.

(56) References Cited

U.S. PATENT DOCUMENTS

| | | | | |
|---|---|---|---|---|
| 2,428,682 | A | 10/1947 | Rhodes | |
| 2,451,274 | A | 10/1948 | Carder | |
| 2,510,643 | A | 6/1950 | Long | |
| D159,919 | S | 8/1950 | Munn | |
| 2,518,572 | A | 8/1950 | Sanders | |
| 2,522,549 | A | 9/1950 | Waggoner | |
| 2,723,696 | A | 11/1955 | Kase | |
| 2,920,671 | A | 1/1960 | Siris et al. | |
| 3,225,805 | A | 12/1965 | Wise | |
| 3,339,781 | A | 9/1967 | Schurman et al. | |
| 3,550,663 | A | 12/1970 | Johnston | |
| 3,556,187 | A * | 1/1971 | Elizabeth et al. | 150/105 |
| 3,623,580 | A * | 11/1971 | Toller | 190/115 |

(Continued)

OTHER PUBLICATIONS

Sarah Sabalos, "Fall Fashion: Top Picks—Tri-cover Tallulah Tate Handbag ($205 at Just the Thing!)", The State, Columbia, South Carolina, Tuesday, Oct. 5, 2004, p. D3.

*Primary Examiner* — Sue A Weaver

(74) *Attorney, Agent, or Firm* — Browdy and Neimark, PLLC

(57) ABSTRACT

A purse comprising a base formed of rigid transparent or translucent material, and a removable liner that is to be inserted in the base of the purse so as to be visible from outside the base, the removable liner being provided in a plurality of colors and textures and patterns and being made of a pliable, sturdy material, wherein the liner provider a creative, decorative design for the purse.

18 Claims, 22 Drawing Sheets

U.S. PATENT DOCUMENTS

| | | | | |
|---|---|---|---|---|
| 3,903,944 | A | 9/1975 | Montgomery et al. | |
| 4,022,261 | A * | 5/1977 | Russell | 150/129 |
| 4,112,991 | A | 9/1978 | Barbaresi | |
| 4,163,484 | A | 8/1979 | Delaney | |
| 4,171,717 | A | 10/1979 | Fleming | |
| 4,177,909 | A | 12/1979 | Haskell | |
| 4,649,974 | A | 3/1987 | Takanashi | |
| 4,716,947 | A * | 1/1988 | Haddock | 150/106 |
| 5,004,091 | A | 4/1991 | Nato et al. | |
| 5,107,971 | A | 4/1992 | Freeman | |
| 5,178,198 | A | 1/1993 | Fitzgerald | |
| D334,661 | S | 4/1993 | Kohn | |
| 5,533,558 | A | 7/1996 | Carey et al. | |
| 5,881,788 | A | 3/1999 | Hersh et al. | |
| 5,894,975 | A | 4/1999 | Holden et al. | |
| 6,220,318 | B1 | 4/2001 | Pinti | |
| 6,231,233 | B1 * | 5/2001 | Orce | 383/38 |
| D483,563 | S * | 12/2003 | Dwight et al. | D3/243 |
| 7,296,665 | B2 * | 11/2007 | Morszeck | 190/125 |
| 2003/0102063 | A1 | 6/2003 | Brody | |

* cited by examiner

PURSE WITH INTERCHANGEABLE DECORATIVE LINERS

RELATED APPLICATIONS

This application claims priority to U.S. Provisional application Nos. 60/623,863 filed on Nov. 2, 2004, and 60/649,086 filed on Feb. 3, 2005, which are hereby incorporated by reference in their entirety.

FIELD OF INVENTION

The present invention relates to a purse which utilizes a transparent or translucent base and interchangeable liner to enable the user to custom design and custom decorate all four sides and the bottom of the purse.

BACKGROUND

There are known types of purses, such as U.S. Pat. Nos. 2,518,572 to Sanders; 2,522,549 to Waggoner; 2,723,696 to Kase; 2,920,671 to Siris; 3,550,663 to Johnston; 3,556,187 to Speakes; 4,022,261 to Russell; 4,171,717 to Fleming; 4,649,974 to Takanashi; 5,178,198 to Fitzgerald; 5,533,558 to Carey; 5,894,975 to Holden; 5,881,788 to Hersh; 6,220,318 to Pinti; and Des 334,661 to Kohn (cited references incorporated herein by reference).

SUMMARY OF INVENTION

An object of the present invention is to provide a purse.

It is a further object of the present invention to provide a purse which utilizes a transparent or translucent base and an interchangeable liner to enable the user to custom design and custom decorate the purse and change the total appearance of the purse by interchanging liners or substituting other backing, photos, graphic design, etc.

The scope and content of the present invention is not intended to be limited by or to the above mentioned objects.

Briefly, the invention is characterized in particular by a purse comprising a base formed of rigid transparent or translucent material, and a removable, interchangeable liner that is to be inserted in the base of the purse so as to be visible from outside the base, the removable liner being provided in a plurality of colors and textures and patterns and being made of a pliable, sturdy material, which may or may not be utilized with a foam and/or fabric laminate, wherein the liner provides a creative, decorative design for the purse.

BRIEF DESCRIPTION OF THE DRAWINGS

For better understanding of the invention and additional objects and advantages thereof, reference is made to the following detailed description and accompanying drawing of a preferred embodiment, wherein.

DETAILED DESCRIPTION

Figure 1:
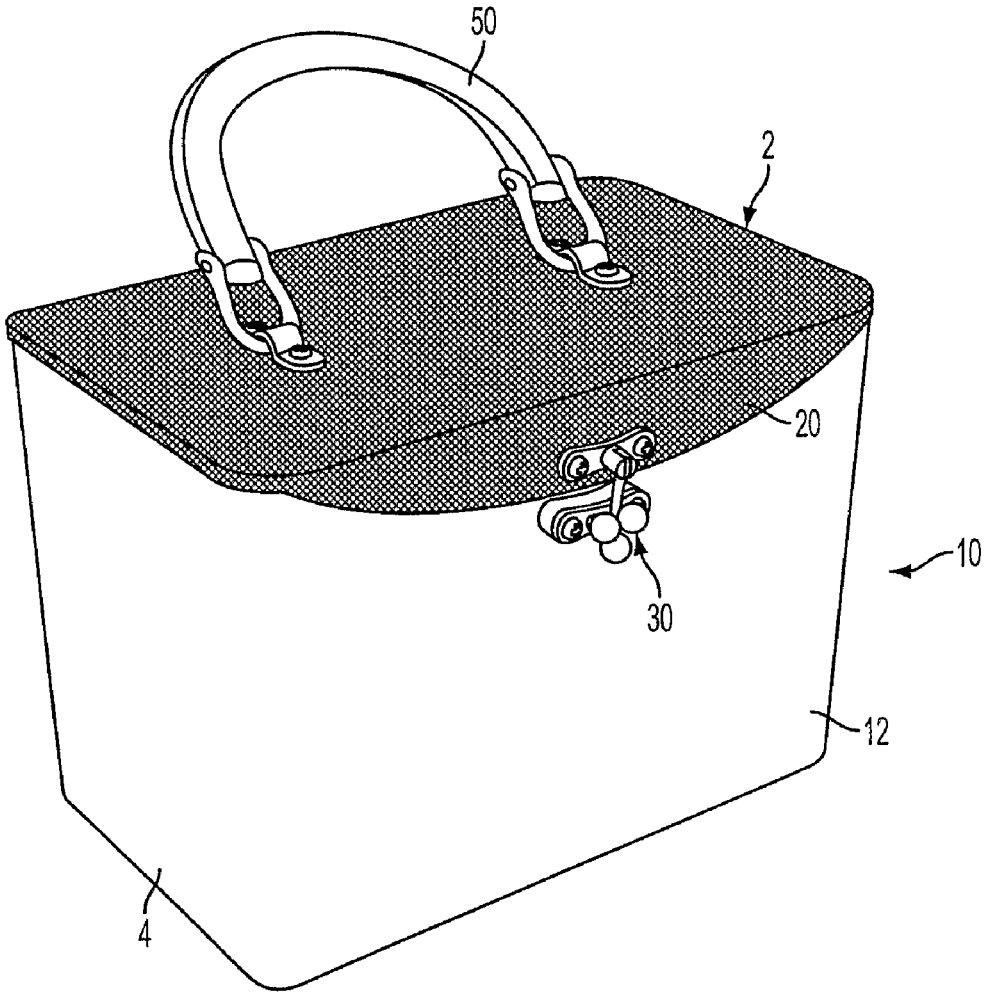
FIG. 1 illustrates a perspective view of the purse in accordance with one embodiment of the present invention.
Figure 2:
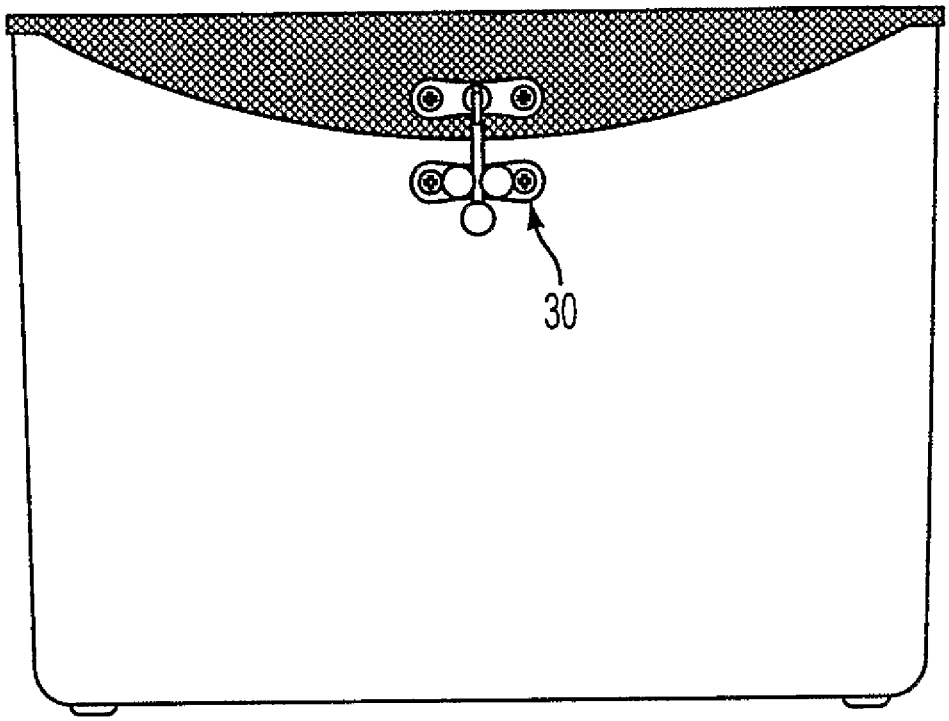
FIG. 2 is a front view of the purse of FIG. 1 in accordance with one embodiment of the present invention.

This invention relates to a purse which utilizes a transparent base and an interchangeable liner to enable the user to custom design and custom decorate all four sides and the bottom of the purse and change the total appearance of the purse by interchanging liners or substituting other backing, photos, graphic design, etc. Although the Figures and the present application refers to a rectangular shape for the purse which has four sides and a bottom, other shapes are contemplated to come within the scope of the present invention, such as a square, another shape polygon, a substantially circular or substantially oval shape, or other shapes as would be within the skill of the ordinary artisan.

This invention relates to a purse 10, which is formed from rigid transparent or translucent material on the four sides and bottom. (FIGS. 1-10 and 12-18.) According to one embodiment, the top 2 of the purse 10 can be made from rigid plastic or composite material fabricated into various shapes and can be provided in various colors including, but not limited to white, black, mirrored and clear. (FIGS. 1-10 and 12-18.) The top 2 shall be hinged to the base container 4 itself with one or more hinges 6 being placed so as to connect the top 2 and one side of the purse. (FIGS. 3, 8-10, and 13B.) The opposite side of the top 20, and opposite side of the base 12, i.e., the side opposite the hinges (the opening top and side) of the purse shall have another closing or locking mechanism 30 which may contain a hasp, snap lock, metal clasp, or other similar locking device. (FIGS. 1-2,4-7, and 12, 13A, and 14-18.)

The invention also includes a series of pliable yet sturdy liners 190 made of plastic or other composite material, which may or may not be utilized with a foam and/or fabric laminate, the liners themselves being of such material that they need no additional reinforcing or stiffening. (FIGS. 11 and 19-23.) By series is meant that one or more of the liners are available to be inserted into the purse base 12. The liners 190 can come in various colors and shades. The liners 190 may be provided in a particular design or pattern or they may be of a solid color or a solid with stamped, heat set or other application of design. The liners 190 are specifically purposed to constitute an essential creative, decorative component for this purse on all four sides and the bottom of the purse. The liners 190 allows the users to apply graphic designs, creative artwork, photos, and other memorabilia inserted between the liner and the transparent or translucent body of the base on all four sides and the bottom of the purse. The liners 190 will allow for the removal and insertion of new and different inserts of graphic designs, photos, and fan memorabilia.

The liners 190 can be viewed through the transparent or translucent surfaces of the purse itself. The ability to remove and insert new or different liners will allow the user to utilize the same purse to express a different theme or a different design and color on all four sides and the bottom of the purse so as to completely alter the purse with the theme or style of expression.

Another intention of the device is to allow for the insertion of items between the transparent or translucent plastic material which composes the body of the purse 10 and the liner 190 so as to be able to display, through the transparent or translucent plastic material of the body, different objects such as photographs, drawings, fabric and other memorabilia that can be flattened such as leaves, flowers and the like.

A carrying handle 50 or handles may be attached to the purse at two or more points with a swivel style or other attaching mechanisms 52 which shall allow the user to replace the handles to likewise suit the user's expression, taste and sense of style. (FIGS. 1, 3-4, 6, and 12-18.) The carrying handle 50, or handles, which may be attached to the lid of the purse or the sides of the base.

The handles may be attached to the top and base of the purse by various methods including a swivel style attaching mechanism, screws, rivets, resins and adhesives, or attaching components molded into the lids and base of the purse through the manufacturing process of injection molding, thermoforming, compression molding, vacuum forming or other methods or plastic fabrication. (FIGS. 1, 3-4, 6, and 12-18.) Molding the attaching components for the handles in to the lid eliminates the use of hardware to attach the handles to the lids, resulting in a cost saving during the manufacturing process.

According to one embodiment of the invention, the contents of the purse are hidden from the outside of the purse itself by virtue of the use of the removable, opaque liner. However, according to another embodiment, the user can select a purse that is transparent or translucent and use it without the liner, if it is the user's desire.

The liner 190 includes not only side panels, but a bottom panel as well which serves as a buffer between the contents of the purse and the purse itself, thus avoiding scratching, scuffing, or chipping of material utilized for the construction of the purse itself. The manufacturing of the purse itself, for the most part shall be by means of hand fabrication or injection molding intended for mass production. The purse body may be made from a suitable rigid material, such as TENITE®, i.e., cellulose acetone propionate, made by Eastman Chemical Co.

Modification and the details of construction/manufacture of the purse may be made. This description should be understood to place no limitations upon the size, limit, shape or specification of the invention but only to provide a description of the invention so as to allow for a provisional patent.

According to the present invention, a ladies purse, which has as a component a liner that enables the user to custom design all four sides and the bottom of the purse by substituting the liners or inserting photos, fabric sheets, graphic designs, collegiate and sporting insignia, fan memorabilia, and other collectibles between the liner and the base of the purse.

The purse may be manufactured by injection molding, thermoforming, compression molding, vacuum forming or other methods of plastic fabrication deemed applicable.

Figure 12:
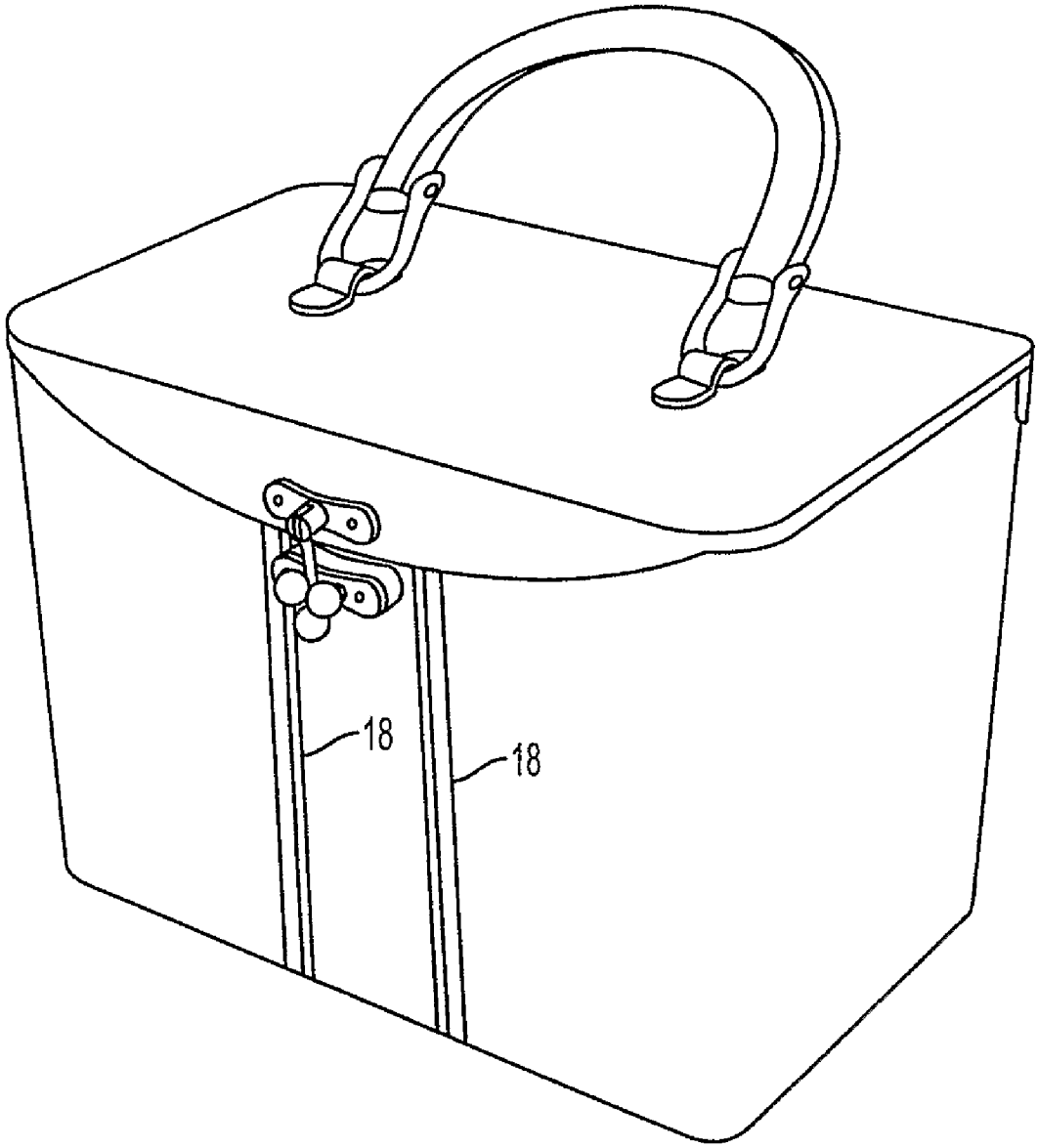
FIG. 12 is an illustrations of a front perspective view of the purse in accordance with another embodiment of the present invention.
Figure 13A:
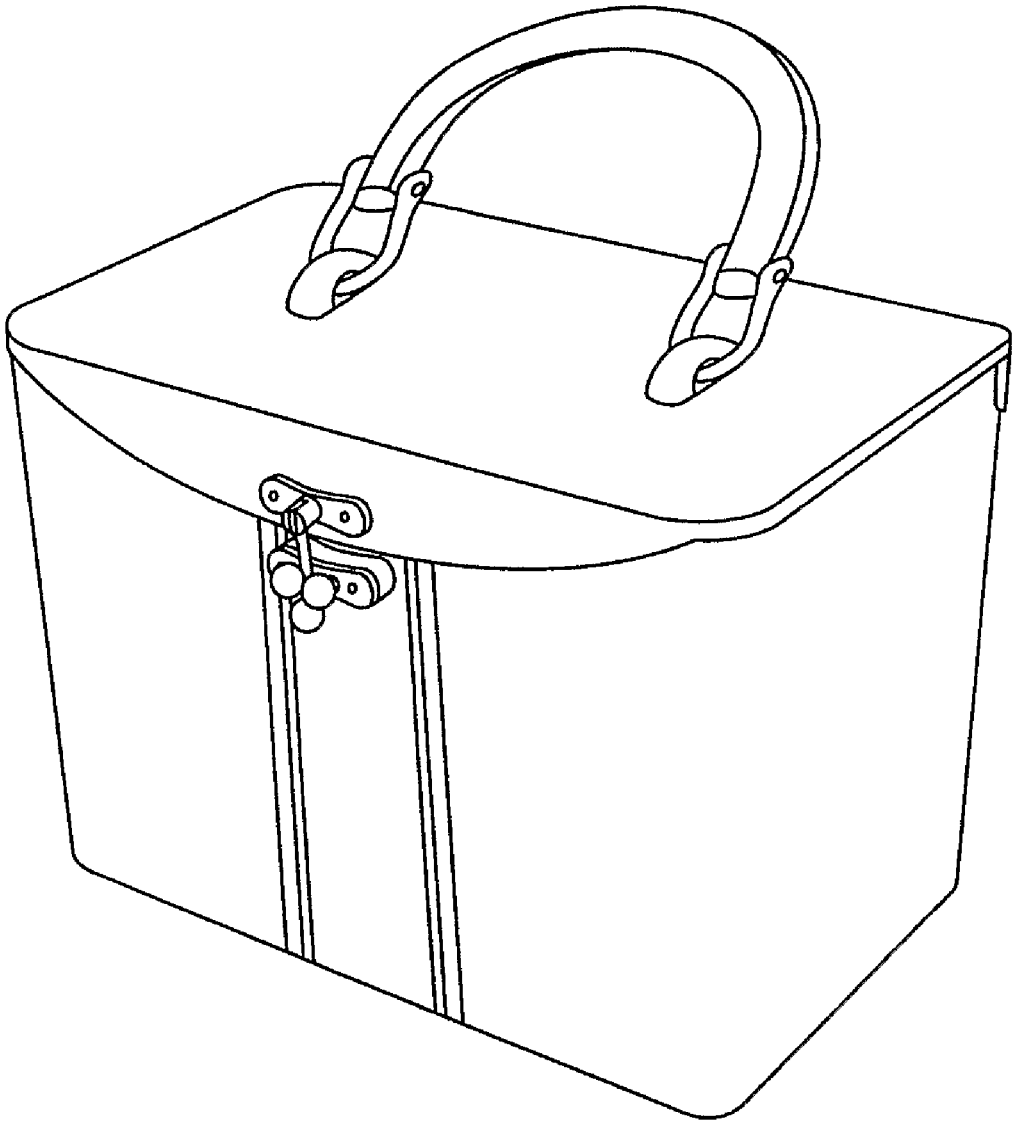
FIGS. 13A and 13B are the front and rear views of the purse in accordance with another embodiment of the present invention.
Figure 14:
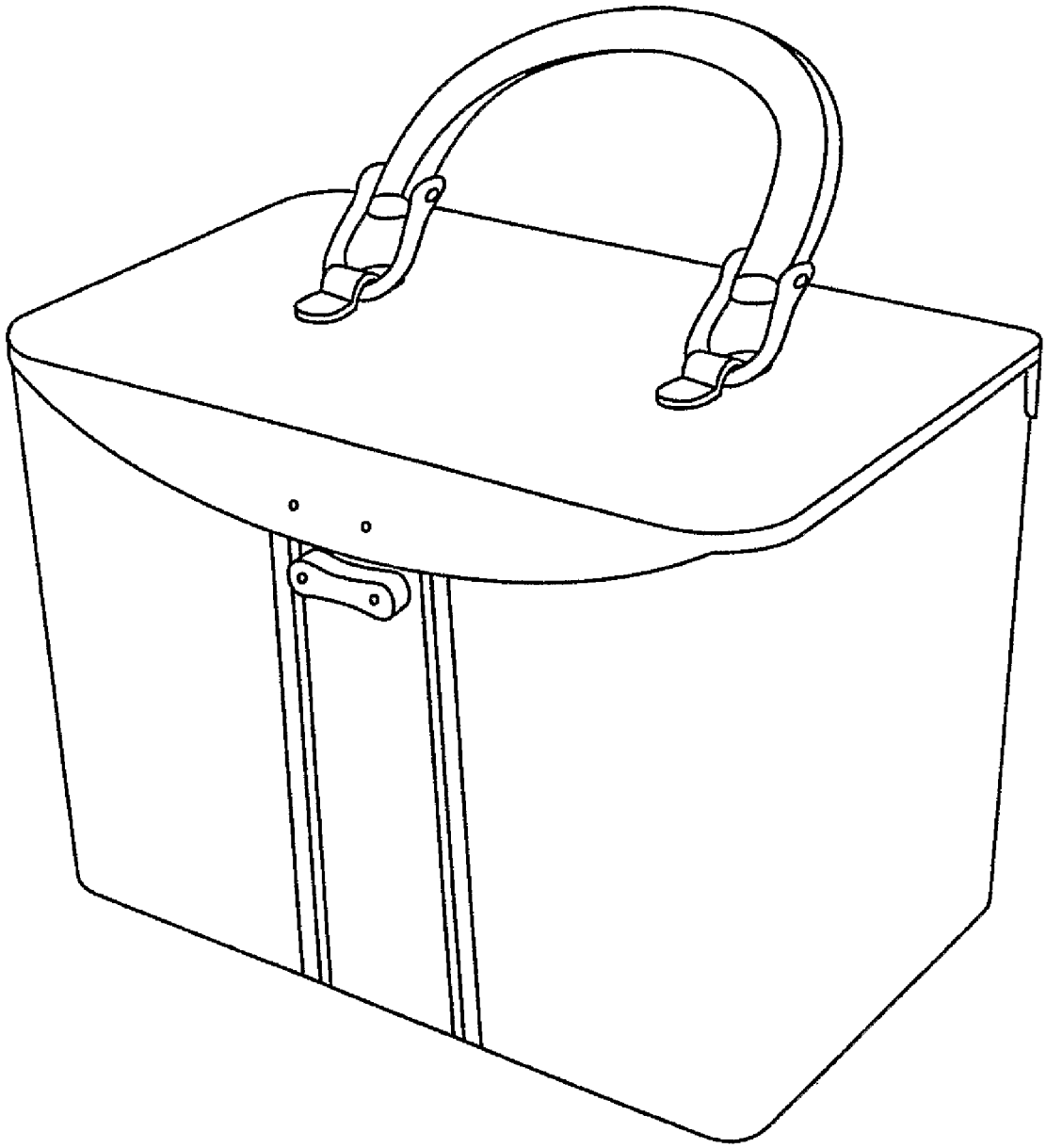
FIG. 14 illustrates a front perspective view of the purse in accordance with another embodiment of the present invention.
Figure 15:
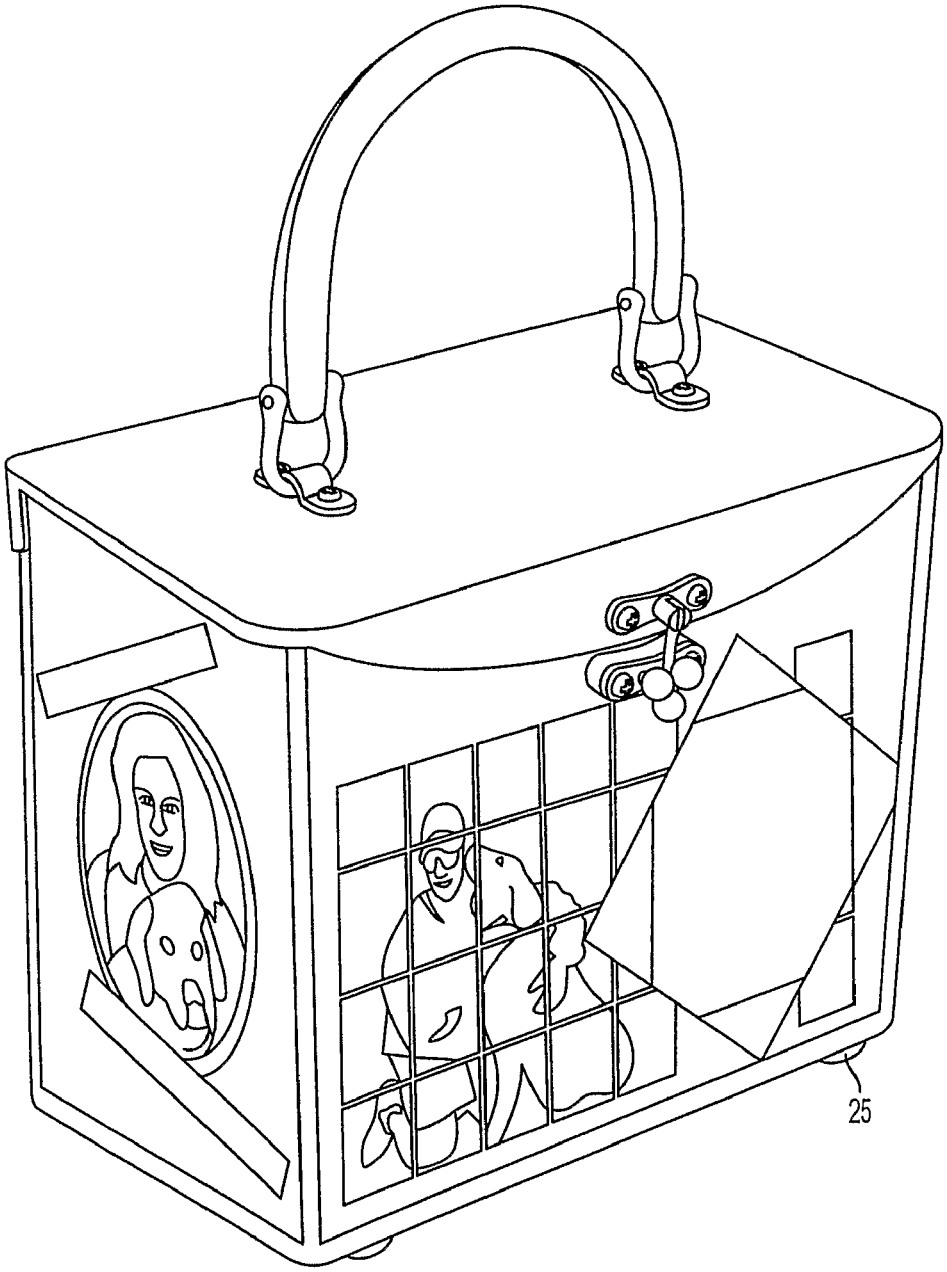
FIGS. 15-18 are photographs of purses with different pictures on the liners or inserted between the liner and the base of the purse, in accordance with one embodiment of the present invention.
Figure 16:
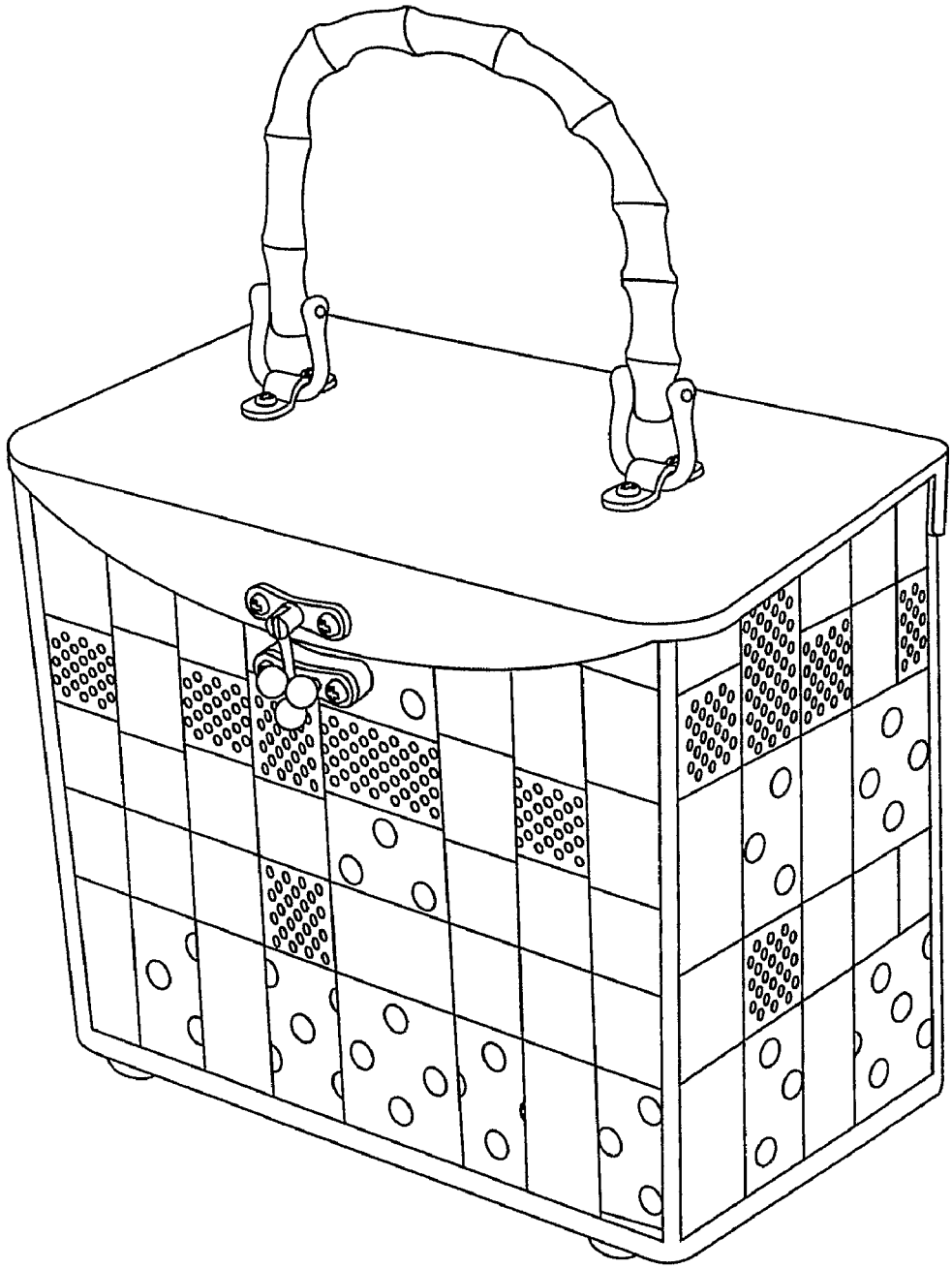
Figure 17:
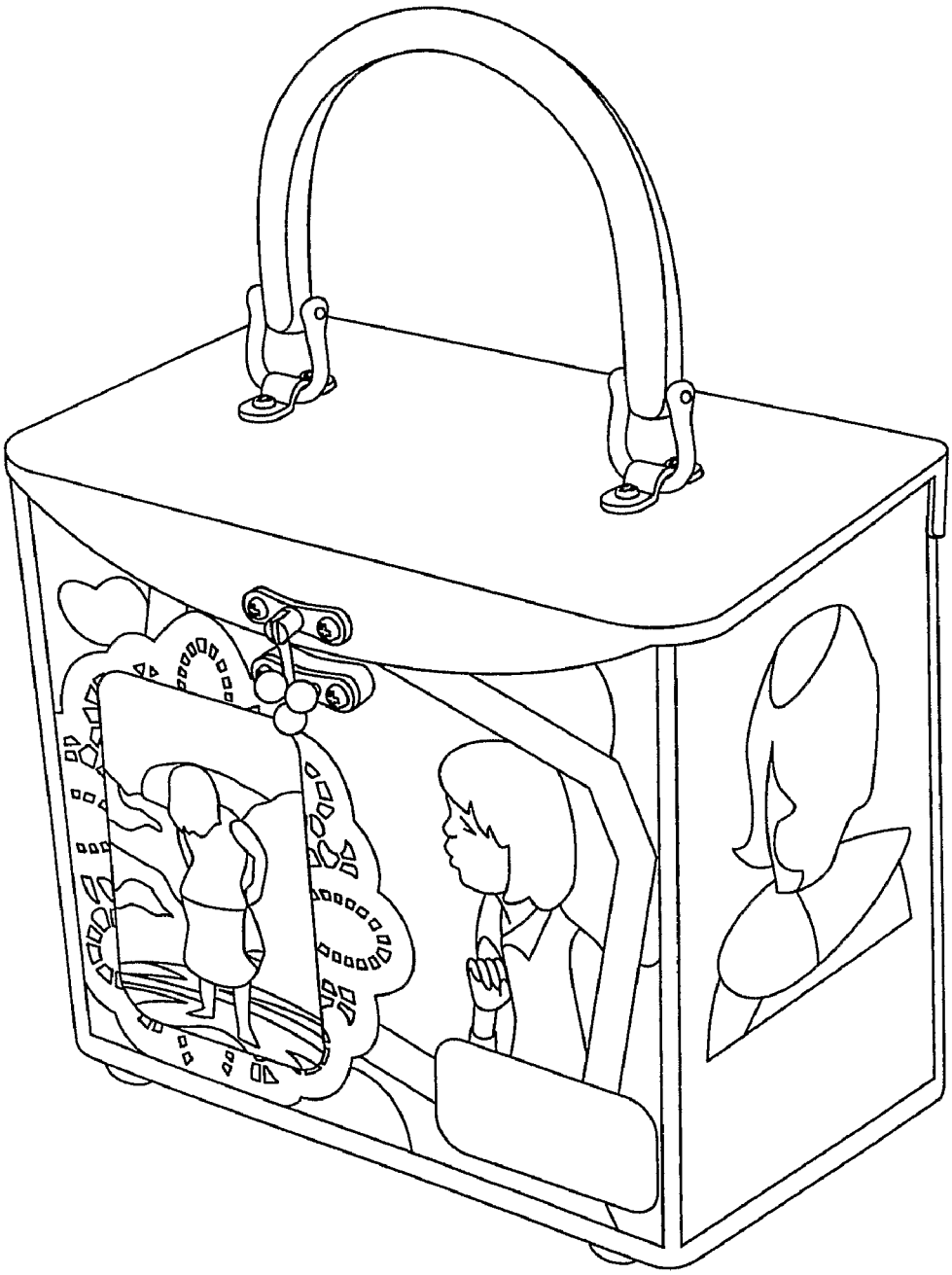
Figure 18:
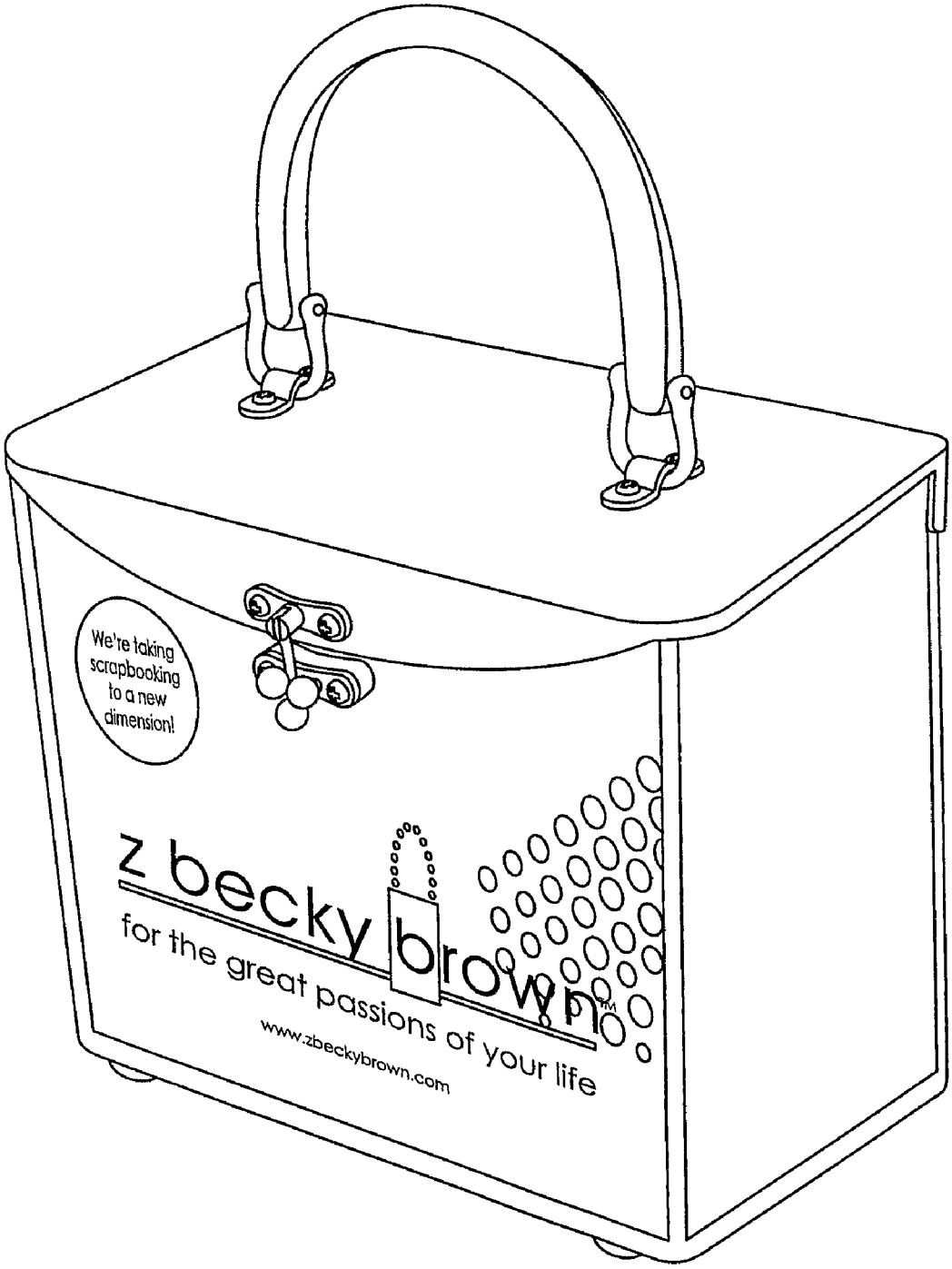
Figure 19:
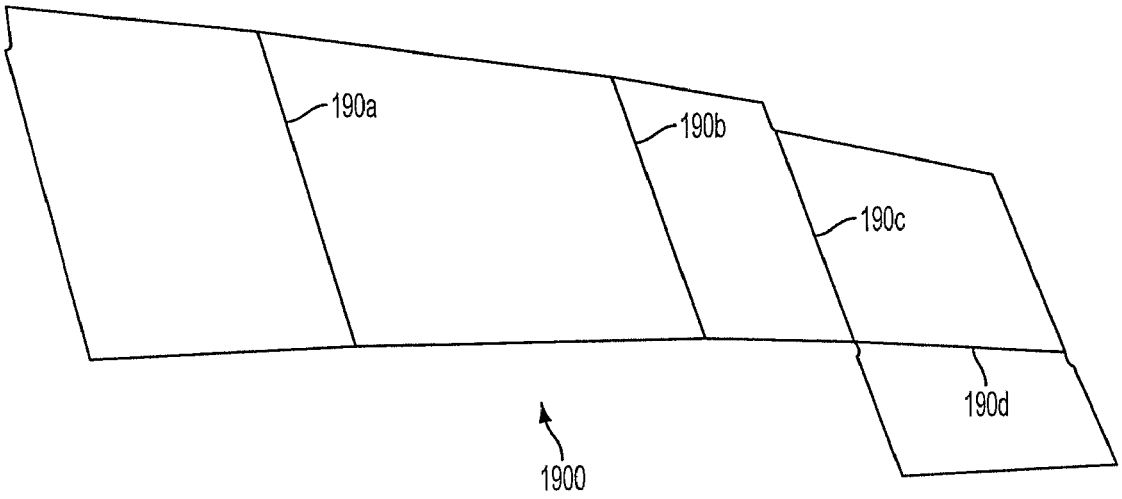
FIGS. 19-23 are views of the interchangeable liner according to one embodiment of the present invention.

The purse may be rectangular, circular, hexagonal, or any other shape, which can be fabricated by the previously mentioned means. The front surface of the purse may be provided with raised embossments or strips 18 as shown in FIGS. 12, 13A and 14. These embossments may be provided in any desired shape or design in such a way as to allow the clasp or closing hardware to meet flush with one another on the lid and the front of the purse.

The surfaces of the sides of the purse may be etched by laser or alternate methods so as to create a logo, monogram or any other design on the surfaces.

A purse is disclosed which may have various lids 2 made of transparent, translucent, or various colored opaque rigid plastic or composite material manufactured by injection molding, thermoforming, compression molding, vacuum forming or other methods of plastic fabrication deemed applicable.

The lids may have various shapes including a full flap fold, an envelope fold, a full radius tab, a cylindrical form with center divide opening, cylindrical form with side opening, even sided flat lid.

The lids will be attached to the base with a hinged attaching process or by hinges 6 that have been incorporated into the lid and base itself through an injection molding or other manufacturing process. (FIGS. 3, 8-10, and 13B.)

Figure 3:
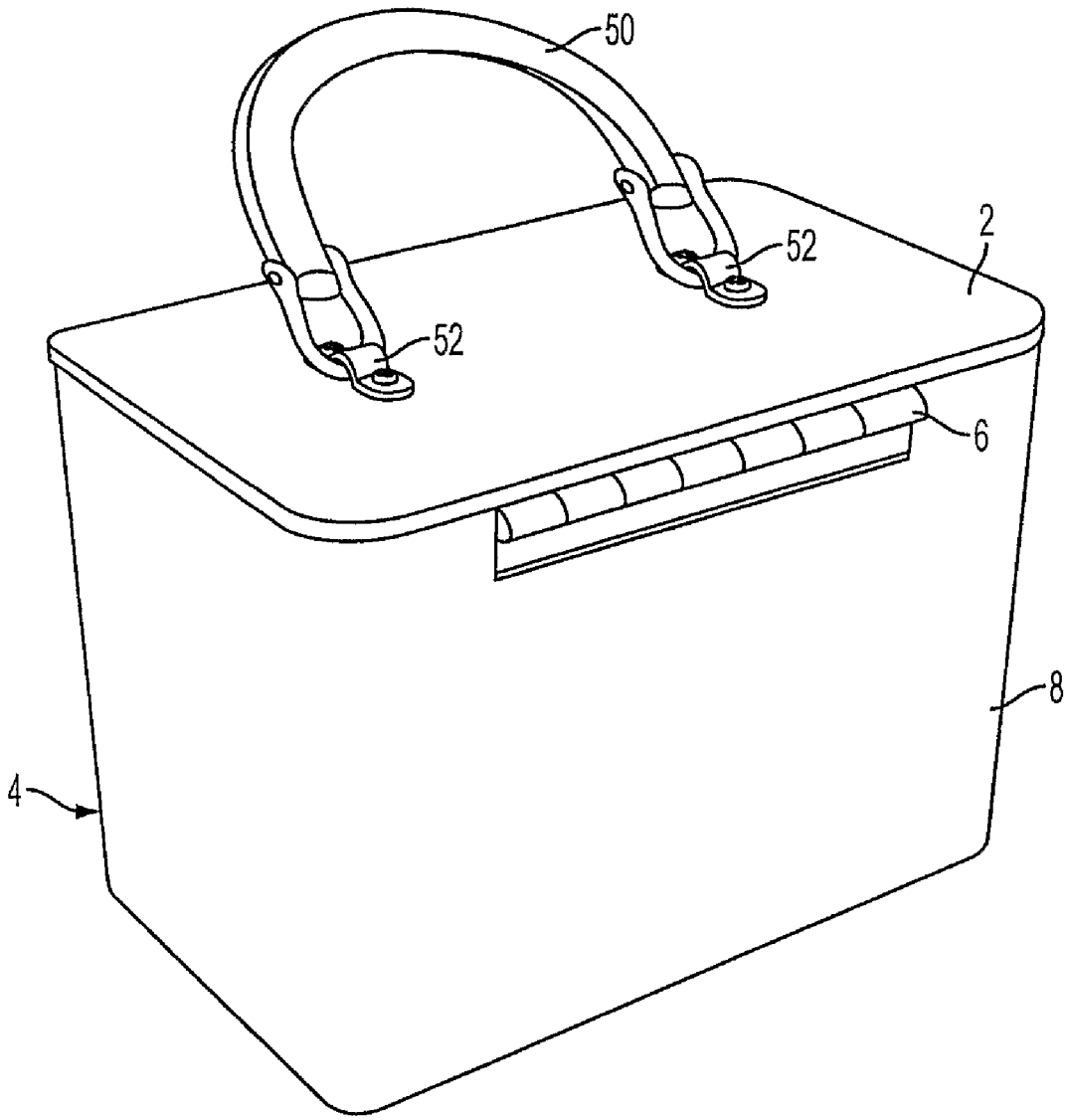
FIG. 3 is a rear view of the purse of FIG. 1, in accordance with one embodiment of the present invention.
Figure 4:
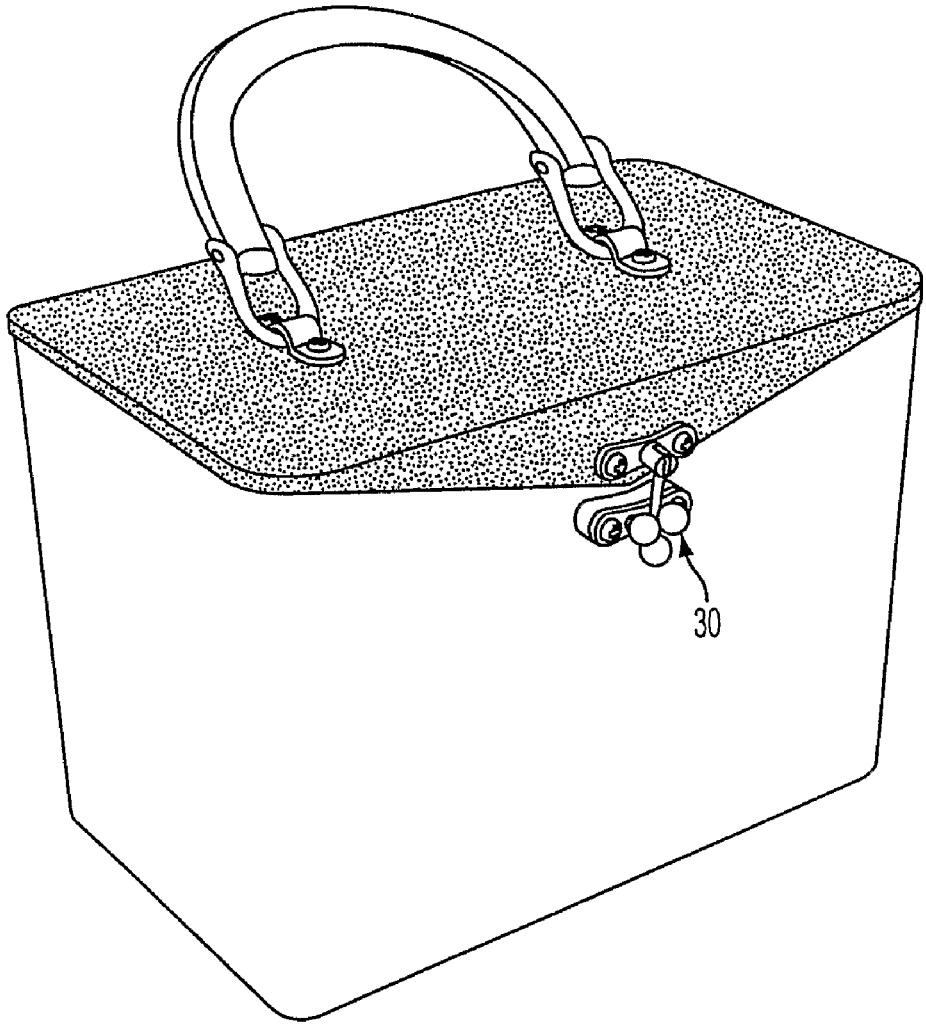
FIG. 4 is a perspective view of the purse in accordance with a another embodiment of the present invention.
Figure 5:
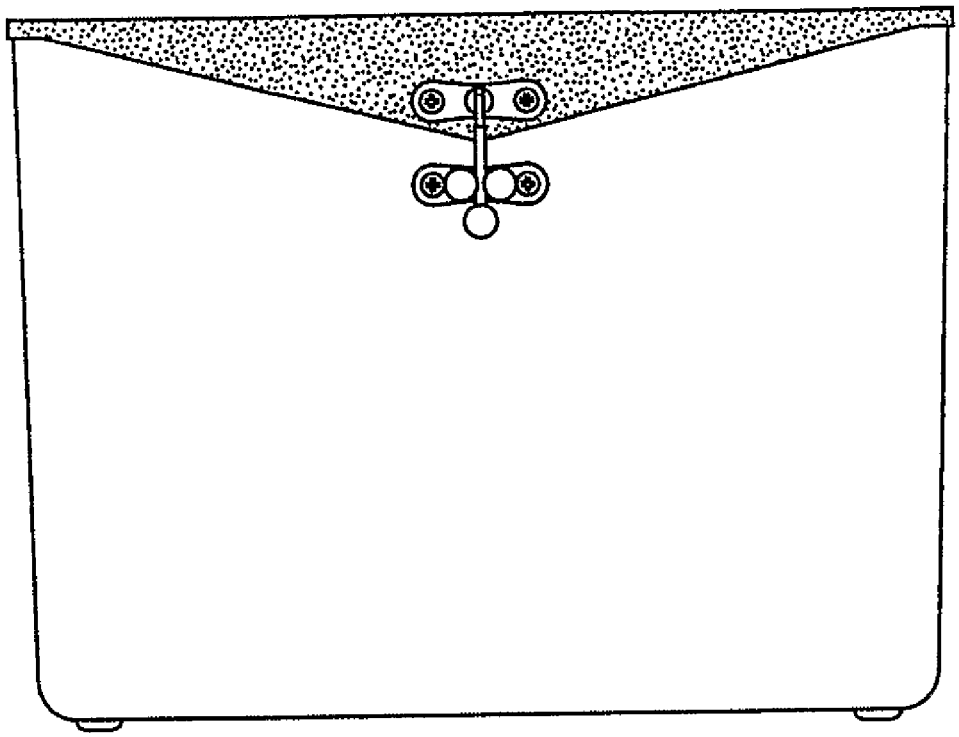
FIG. 5 is a front view of the purse of FIG. 4.
Figure 6:
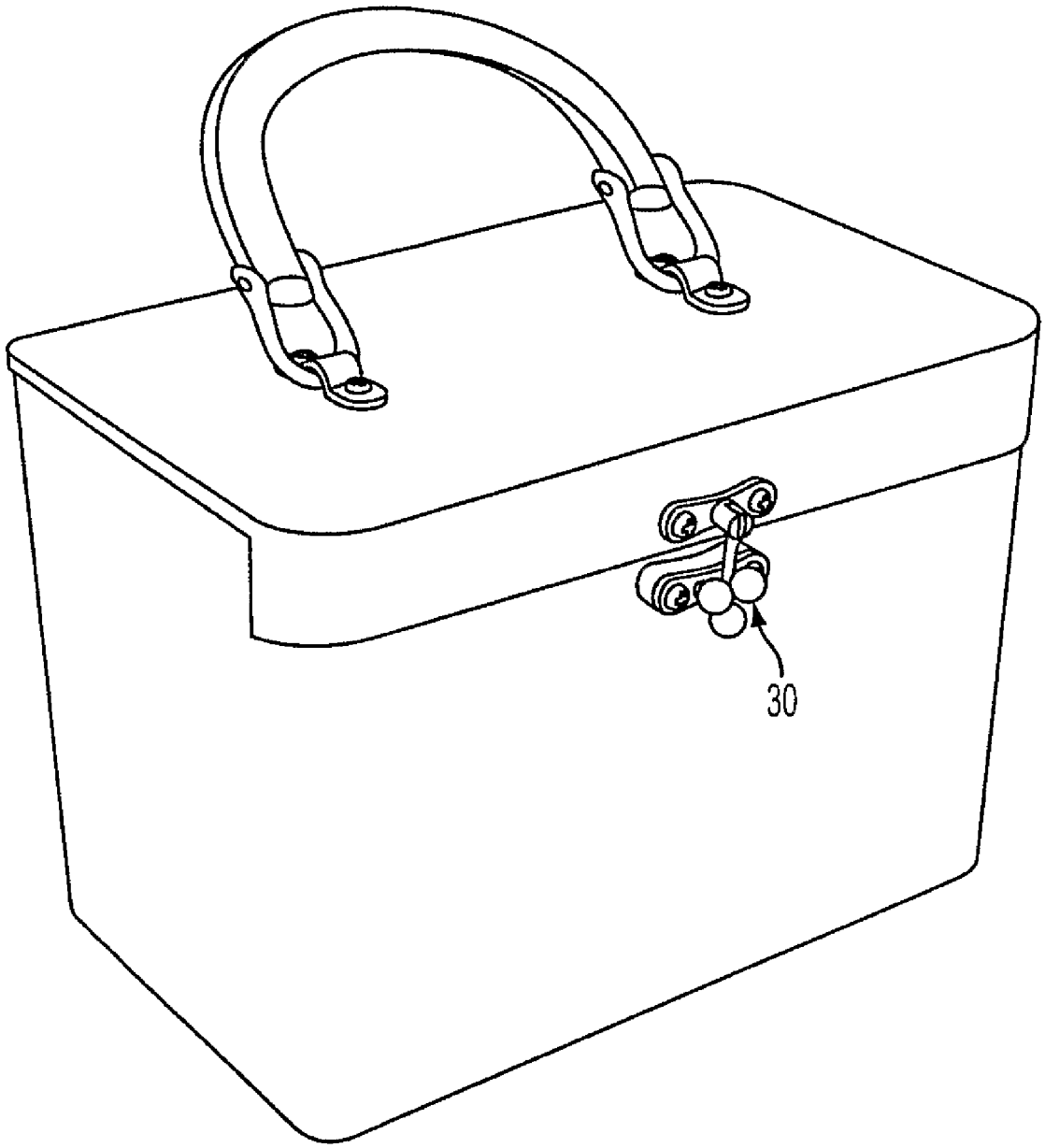
FIG. 6 is a perspective view of the purse in accordance with another embodiment of the present invention.
Figure 7:
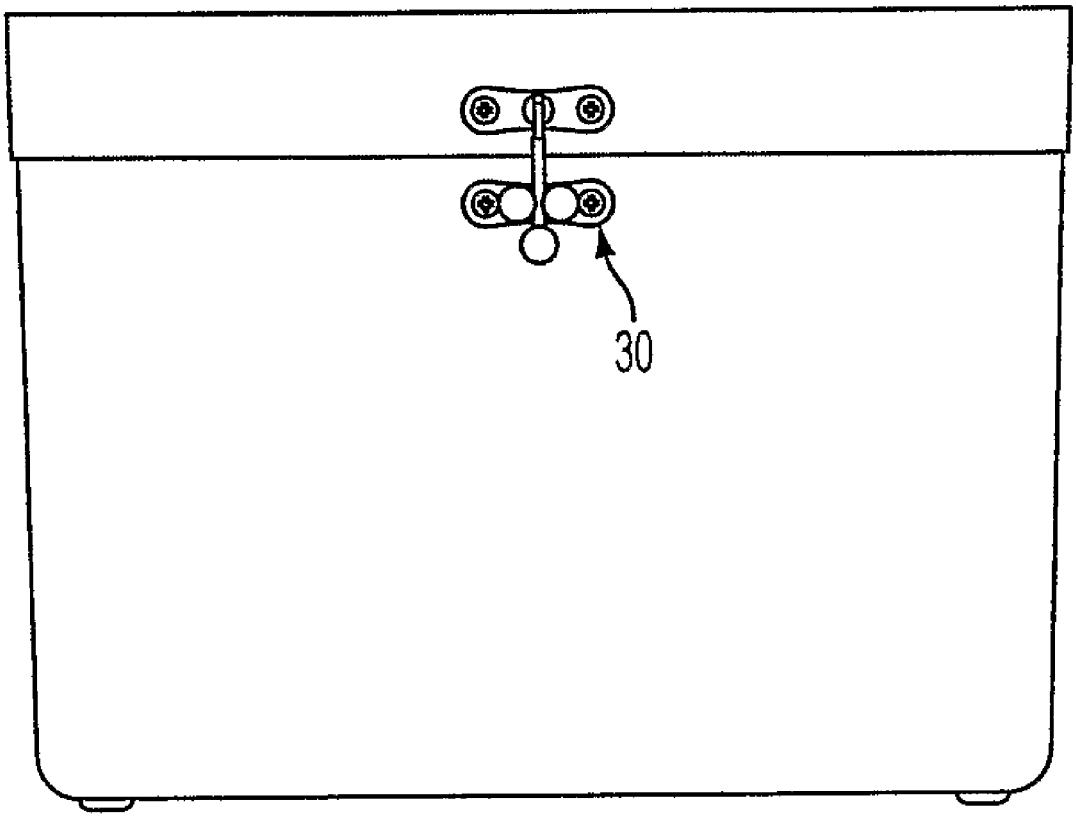
FIG. 7 is a front view of the purse of FIG. 6.
Figure 8:
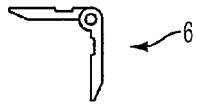
FIG. 8 is an illustration of a side view of a hinge in accordance with one embodiment of the present invention.
Figure 9:
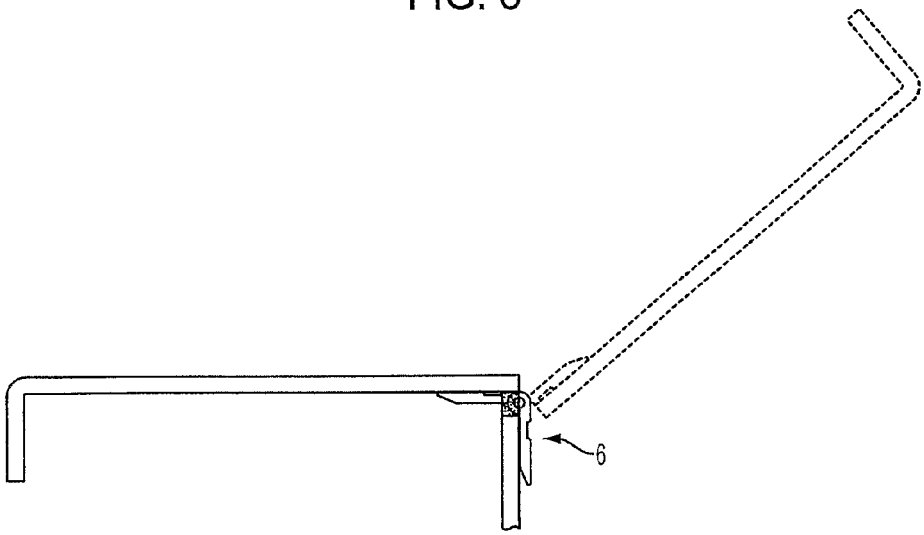
FIG. 9 the connection of the top of the purse to the base via the hinge in accordance with another embodiment of the present invention.
Figure 10:
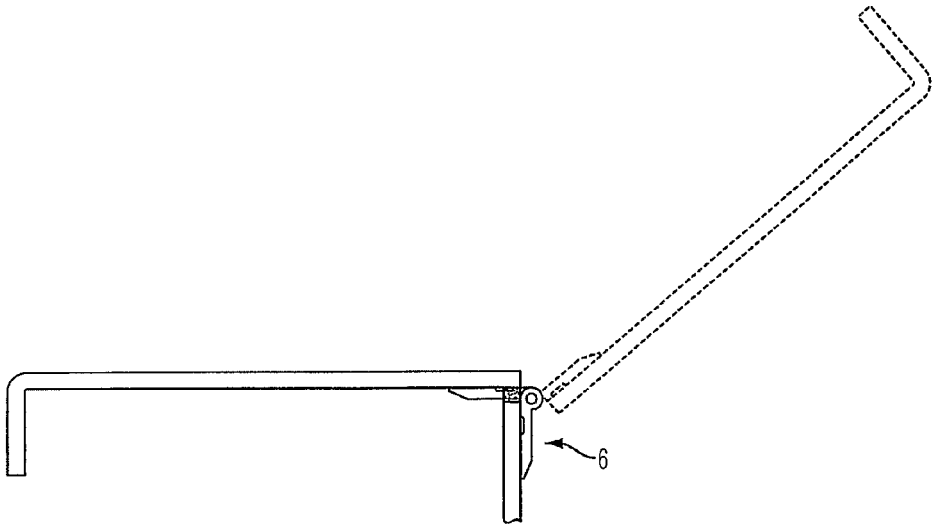
FIG. 10 the connection of the top of the purse to the base via the hinge in accordance with another embodiment of the present invention.

The hinges may be brass, polished nickel or other metals, acrylic or other plastic or composite material. They may be formed as a single hinge 6, extending along a substantial portion of the back of the purse, as shown in FIG. 3, for example, or they may formed as two hinges 16, each disposed on an opposite side of the back of the purse, as shown in FIG. 13B, for example.

The hinges may be attached to the top and base of the purse by various methods including screws, rivets, resins and adhesives, or molded into the lids and base of the purse through the manufacturing process of injection molding, thermoforming, compression molding, vacuum forming or other methods or plastic fabrication.

The lids will have a closing or locking mechanism 30 which secures the purse top to the base in a closed position by an attached hasp, snap lock, metal clasp or other similar locking devise or a locking device which is incorporated into the base and top of the purse through the manufacturing fabrication process of injection molding, thermoforming, compression molding, vacuum forming or other methods or plastic fabrication.

Figure 13B:
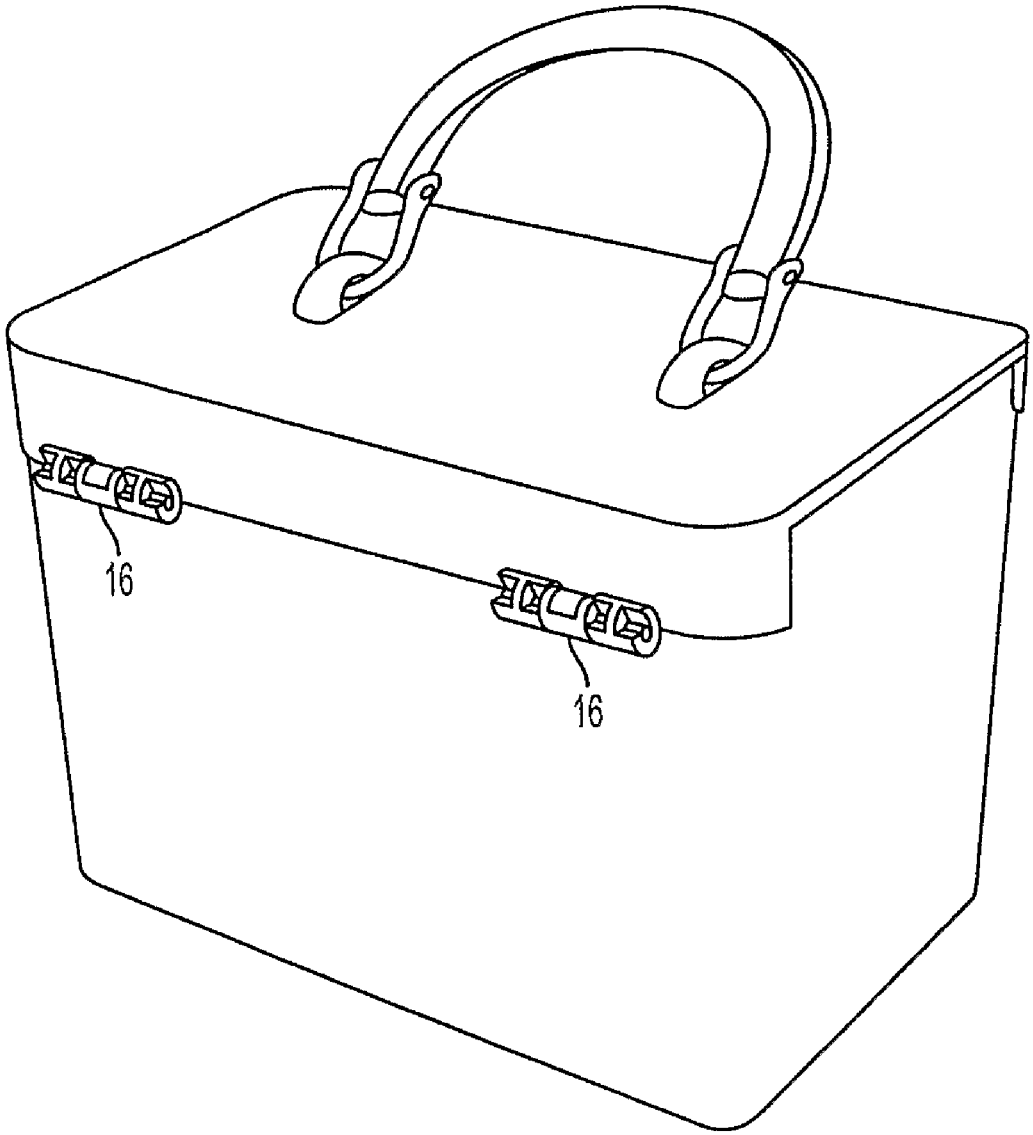

The lids 2 may shaped so as to end flush with the back of the purse (e.g., FIG. 3) or may extend over the back of the purse (e.g., FIG. 13B).

The purse may be sold with or without pliable, sturdy liners which may or may not be utilized with a foam and/or fabric laminate and can be made in various colors and textures and patterns made of plastic or other composite material which constitute an essential creative, decorative component of the four sides and bottom of the purse.

The liners may be manufactured by die-cutting and scoring, injection molding, thermoforming, compression molding, vacuum forming or other methods or plastic fabrication and may be laminated with attached foam, fabric and/or similar material. In other words, a sheet of foam may be laminated to a sheet of fabric, which composite may be laminated to the liner. Alternatively, a sheet of fabric or foam may be laminated to the liner by itself. According to one embodiment, the liner is made of a thermoplastic sheet material, for example ROYALITE DKE 400. The material for the thermoplastic sheet material is made by Uniroyal, Inc. and comprises a rubber resin mixture. Other materials within the scope of the invention are within the skill of the art.

Figure 11:
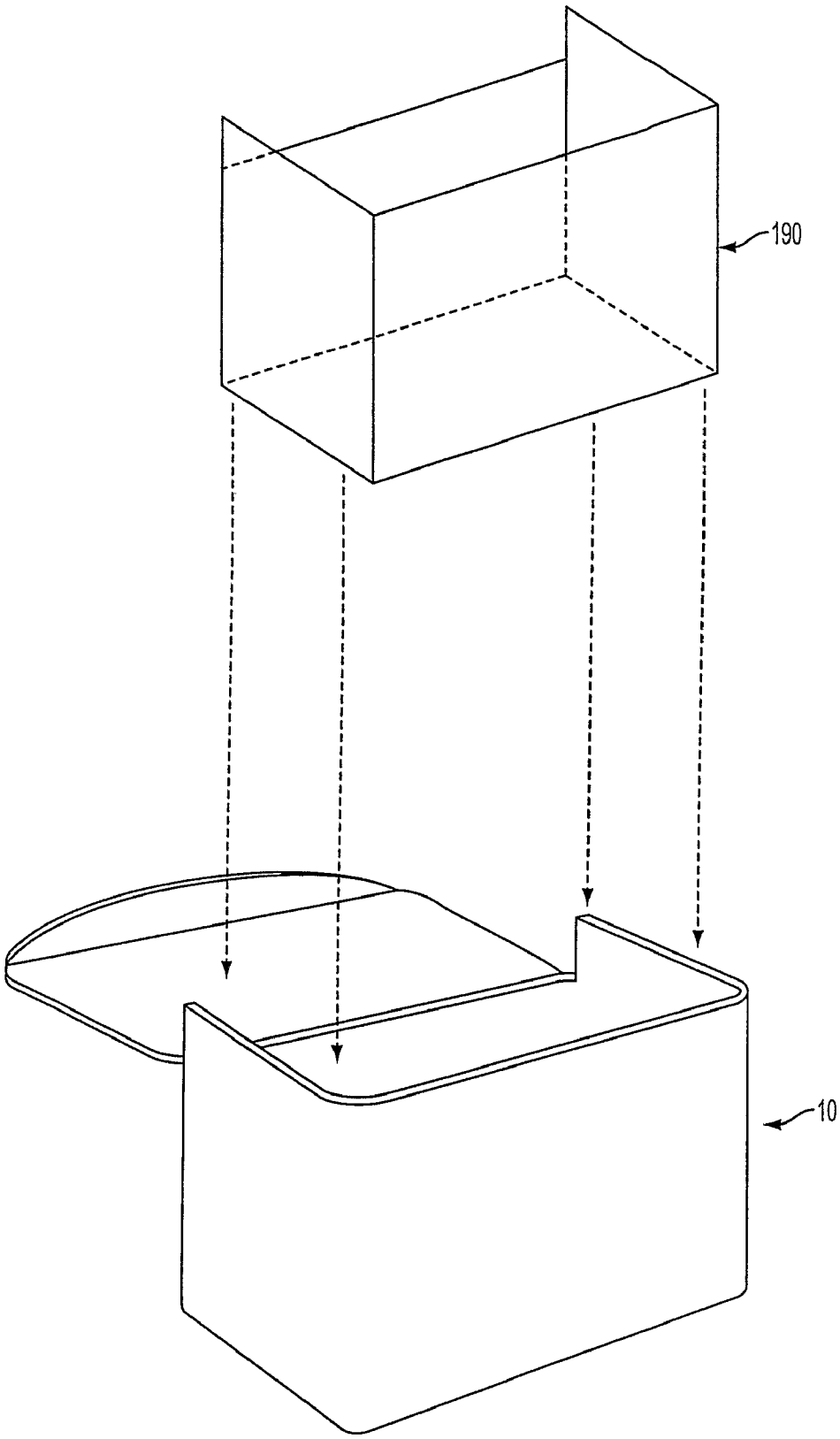
FIG. 11 illustrates insertion of the liner into the base of the purse according to one embodiment of the present invention.
Figure 20:
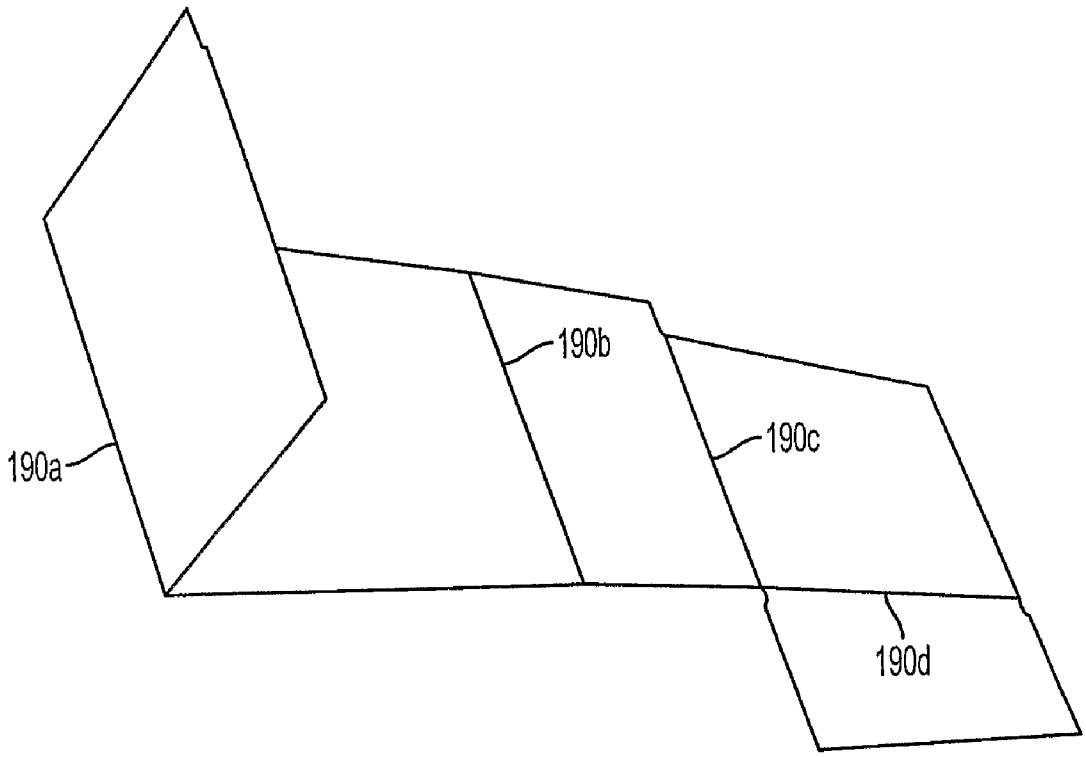
Figure 21:
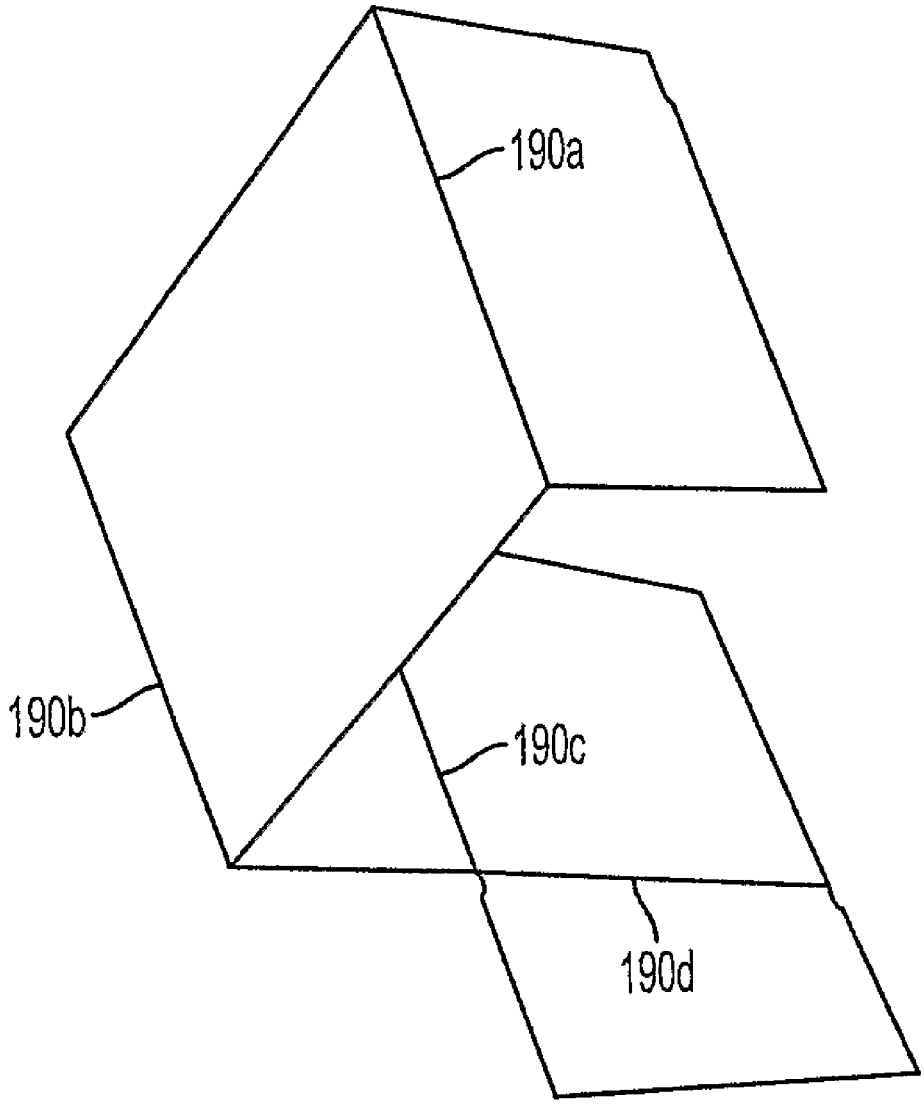
Figure 22:
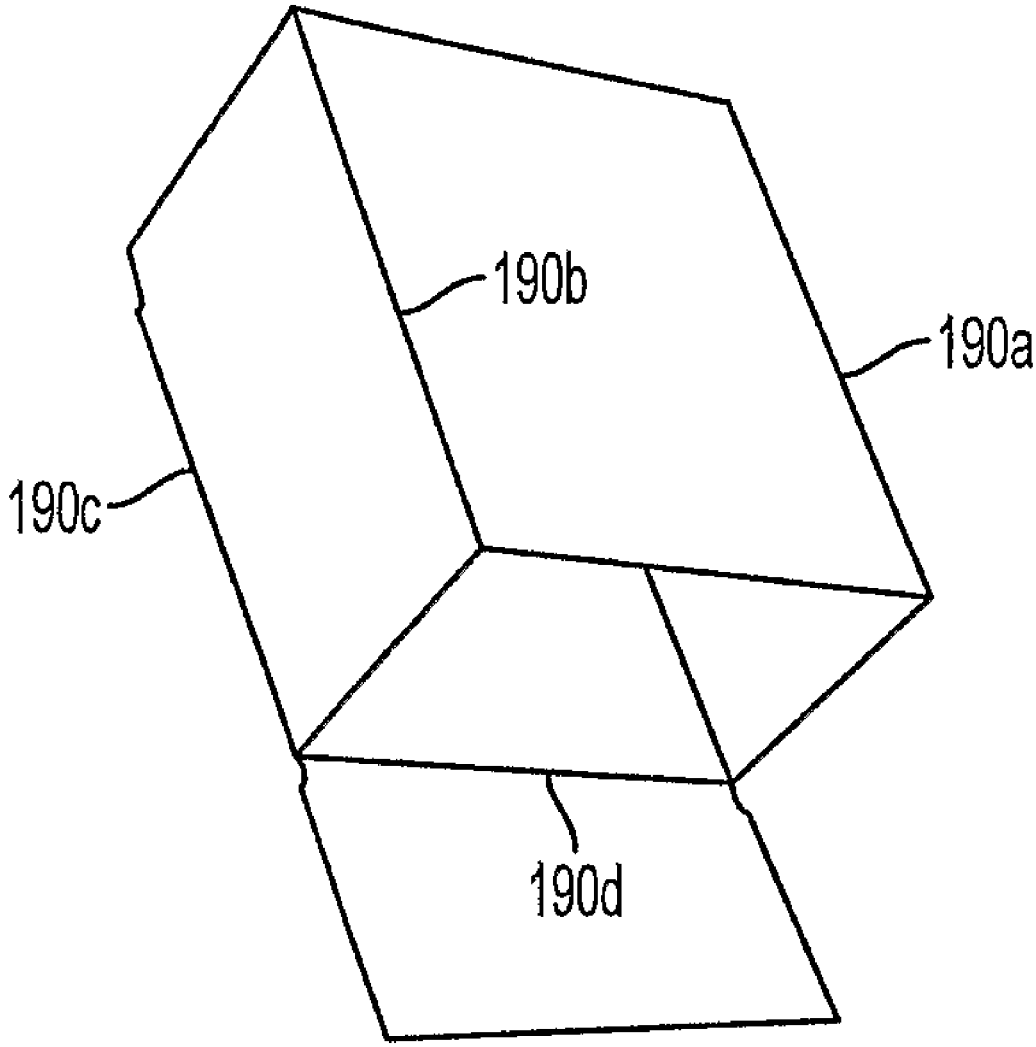
Figure 23:
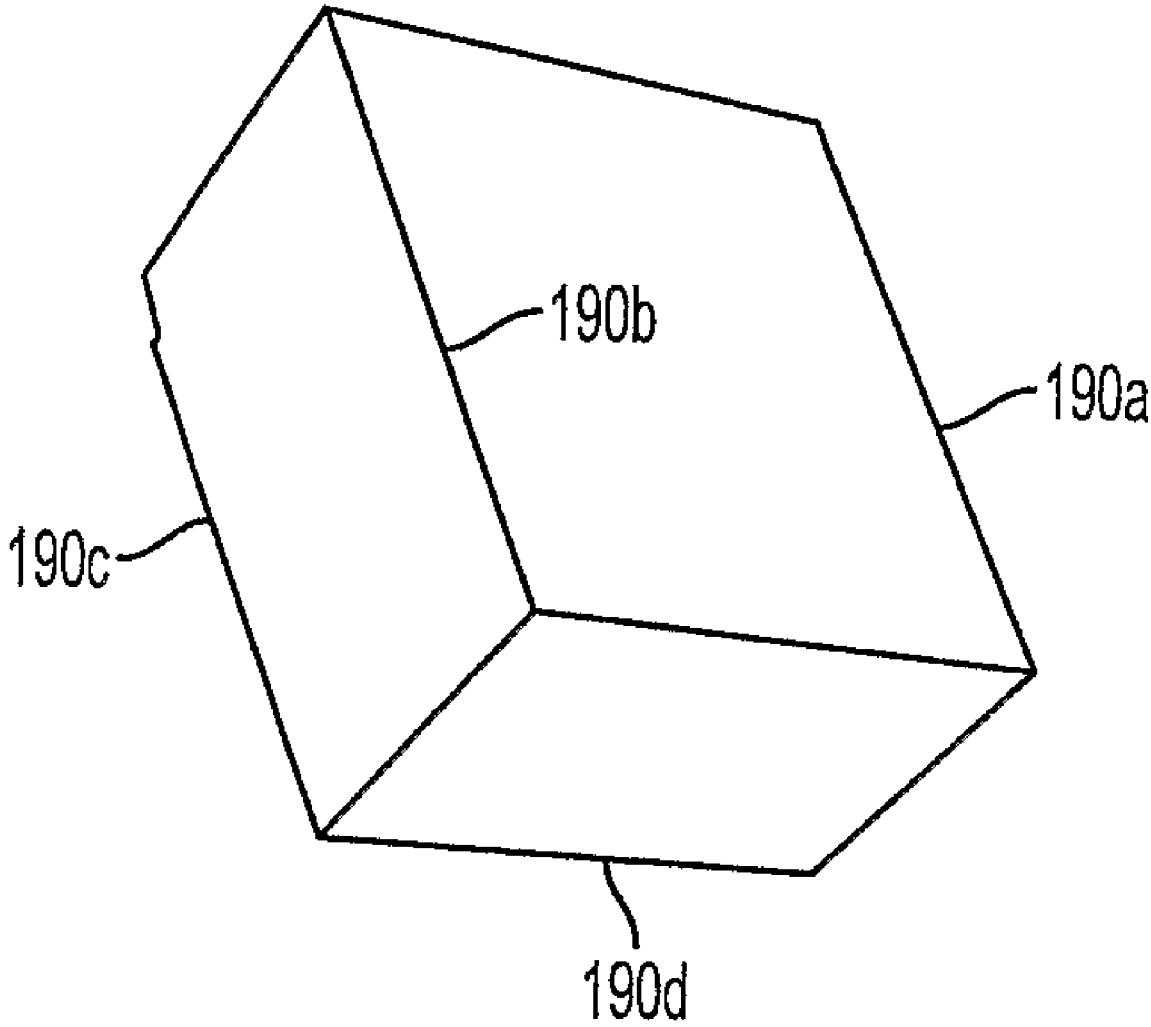

According to one embodiment, shown in FIGS. 19-23, the liner is manufactured by cutting a template 1900 from a sheet of the material from which the liner is to be made. The template is folded in four places, shown in FIG. 19 as 190A, 190B, 190C and 190D. FIG. 20 shows the first fold being made on fold line 190A, FIG. 21 shows the next fold being made being made at fold line 190*b*, FIG. 22 shows the next fold being made at fold line at fold line 190C, and finally FIG. 23 shows the final fold being made at fold line 190D, at which time the liner is folded into its final rectangular configuration. The liner can then be inserted into the base of the purse as shown in FIG. 11.

The liners are designed for easy substitution and manufactured to "fit" the base of the purse yet are not attached to the purse at any point and may be easily removed from the purse for substitution of another color or texture liner so as to completely alter the purse with theme or style of expression.

The liners are designed to serve as backing for material inserted between the base of the purse and the liner and secure the inserted material in place. Although the above description of the different embodiments provides for decorative liners having solid opaque film sheets on outer surfaces, the sheets could also be in the form of images or patterns.

The liners are designed to allow the user to insert graphic design, photos, collegiate and sporting insignia, fan memorabilia, and other collectibles between the liner and the base of the purse and substantiate the inserted material for display. Examples are shown in FIGS. 15-18.

The liners may be transparent, translucent, or opaque to allow the contents of the purse to be hidden. The liners may be screen-printed, heat stamped, or altered with other application of design and may be laminated with foam, fabric or other material.

The purse may have bumpers 25, attached to the bottom of the purse. The bumpers may be of plastic or composite material, attached by solvent or adhesive material. Alternatively, the bumpers may be molded integrally in the base.

Generally, the present invention can employ an infinite number of decorative shapes and sizes, including, for example, squares, rectangles, trapezoids, or any other suitable shape.

Although various features of the invention have been described with particular embodiments, it is considered within one of ordinary skill in the art to mix and match the features in other embodiments not depicted in the figures.

Although the term "purse" has been used to describe the invention, "purse" as used herein can mean handbag or pocketbook as well.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A purse comprising:

a base formed of rigid transparent or translucent material, the base comprising a bottom, four sides extending in the same direction from the bottom, and a lid connected to one of the four sides for closing the purse; and a removable liner that is to be inserted in the base of the purse so as to be visible from outside the base, the removable liner being provided in a plurality of colors and textures and patterns and being made of a pliable, sturdy material, the liner, when inserted in the base, comprises a bottom and four sides extending in the same direction from the bottom, wherein the bottom of the liner is placed adjacent to the bottom of the base and the four sides of the liner are placed adjacent to the four sides of the base, the liner serving as a buffer between purse contents and the base and being unattached to the base, wherein the liner defines a space between the four sides and bottom of the liner and the four sides and the bottom of the base into which decorative pieces may be placed, the decorative pieces selected from the group of photos, graphic designs, collegiate and sporting insignia, fan memorabilia, and other collectibles.

2. The purse according to claim 1, wherein the base is made of a material selected from the group of a plastic and a composite, and is manufactured by a method selected from the group of injection molding, thermoforming, compression molding, and vacuum forming.

3. The purse according to claim 1, further comprising a lid made of rigid material manufactured by a method selected from the group of injection molding, thermoforming, compression molding, and vacuum forming.

4. The purse according to claim 3, wherein the lid material is selected from the group of a plastic and composite material, and is selected from the group of transparent, a translucent, and a colored opaque material.

5. The purse according to claim 3, further comprising a closing mechanism that secures the purse lid to the base in a closed position.

6. The purse according to claim 5, wherein the closing mechanism is selected from the group of an attached hasp, snap lock, or metal clasp.

7. The purse according to claim 3, further comprising a hinge connected to one side of the base and to the lid for pivotably attaching the lid to the base.

8. The purse according to claim 7, wherein the hinge is made from a material selected from the group of brass and polished nickel.

9. The purse according to claim 7, wherein the hinge is made from a material selected from the group of an acrylic and plastic.

10. The purse according to claim 7, wherein the hinge is attached to the lid and base of the purse by one of a plurality of methods, including screws, rivets, resins and adhesives.

11. The purse according to claim 7, wherein the hinge is molded into the lid and base of the purse through during the manufacturing process of the lid and base.

12. The purse according to claim 1, further comprising at least one carrying handle attached to the lid.

13. The purse according to claim 12, wherein the at least one handle is attached to the lid by a method selected from the group of a swivel style attaching mechanism, screws, rivets, resins and adhesives.

14. The purse according to claim 1, further comprising bumpers, protruding from an outside bottom surface of the base.

15. The purse according to claim 14, wherein the bumpers are made of a material selected from the group of a plastic and composite material.

16. The purse according to claim 14, wherein the bumpers are molded integrally in the base.

17. The purse according to claim 1, wherein the decorative pieces are inserted between the liner and the base on at least one side of the base.

18. The purse according to claim 1, further comprising:

at least one carrying handle attached to the lid;

a clasp connected between the lid and one side of the base to close the purse; and a hinge formed as part of the base on a side opposite to the side having the clasp, and connected between the lid and the base to allow the lid to be open and closed.

* * * * *